US006669241B1

(12) United States Patent
Kelley

(10) Patent No.: US 6,669,241 B1
(45) Date of Patent: Dec. 30, 2003

(54) DOOR LATCH OPENING SYSTEM

(76) Inventor: Drew Kelley, 169 Dorchester Rd., Buffalo, NY (US) 14213

( * ) Notice: Subject to any disclaimer, the term of this patent is extended or adjusted under 35 U.S.C. 154(b) by 5 days.

(21) Appl. No.: 10/350,698

(22) Filed: Jan. 23, 2003

(51) Int. Cl.[7] ..... E05C 21/00

(52) U.S. Cl. ..... 292/1; 16/413; 16/422; 16/426; 16/427; 16/901; 292/DIG. 2; 292/336.3

(58) Field of Search ..... 292/DIG. 2, 347, 292/1, 336.3; 403/331, 363, 381, 13; 16/413, 901, 422, 426, 427

(56) References Cited

U.S. PATENT DOCUMENTS

| | | | | | |
|---|---|---|---|---|---|
| 2,058,685 | A | | 10/1936 | Haan, Jr. | 292/347 |
| 3,827,739 | A | | 8/1974 | Overholser | 292/347 |
| 4,006,927 | A | * | 2/1977 | Recupero | 292/336.3 |
| 4,018,465 | A | * | 4/1977 | Ramler | 292/336.3 |
| 4,101,153 | A | | 7/1978 | Dozier | 292/92 |
| 4,223,931 | A | | 9/1980 | Neary | 292/347 |
| 4,285,536 | A | * | 8/1981 | McCoy et al. | 292/336.3 |
| 4,326,738 | A | * | 4/1982 | Loftus et al. | 292/172 |
| D268,984 | S | | 5/1983 | Bergen | D8/308 |
| 4,397,489 | A | | 8/1983 | Lind | 292/347 |
| D280,799 | S | | 10/1985 | Ohno | D8/302 |
| 4,629,228 | A | | 12/1986 | Marko et al. | 292/165 |
| D289,369 | S | | 4/1987 | Foshee | D8/308 |
| 4,728,133 | A | * | 3/1988 | Valley | 292/336.3 |
| 4,971,375 | A | * | 11/1990 | Grecco | 292/347 |
| 5,193,863 | A | * | 3/1993 | McBain | 292/255 |
| 5,231,731 | A | | 8/1993 | Jones, Jr. | 16/114 |
| 5,288,116 | A | * | 2/1994 | Donofrio | 292/336.3 |
| 5,476,295 | A | * | 12/1995 | Smallegan et al. | 292/336.3 |
| 5,492,380 | A | * | 2/1996 | Smallegan et al. | 292/336.3 |
| D369,085 | S | | 4/1996 | Barnett | D8/307 |
| 5,593,193 | A | * | 1/1997 | Heim | 292/336.3 |
| 5,713,614 | A | | 2/1998 | Anderson | 292/336.3 |
| 5,881,433 | A | * | 3/1999 | Mutone et al. | 16/422 |
| 5,960,517 | A | * | 10/1999 | Sprekeler | 292/336.3 |
| 6,390,521 | B1 | * | 5/2002 | Bohlman et al. | 292/348 |
| 6,532,629 | B2 | * | 3/2003 | Armstrong | 16/414 |
| 2001/0026071 | A1 | * | 10/2001 | Kemp et al. | 292/348 |
| 2002/0113445 | A1 | * | 8/2002 | Brown | 292/336.3 |

FOREIGN PATENT DOCUMENTS

| | | | | |
|---|---|---|---|---|
| GB | 2203641 | A | * 10/1988 | A47B/95/02 |

* cited by examiner

*Primary Examiner*—Robert J. Sandy
*Assistant Examiner*—Dinesh N Melwani

(57) ABSTRACT

A door latch opening system for providing efficient and convenient opening of a door latch. The door latch opening system includes an engaging member have a broad engaging area, a receiver member attached to the rear portion of the engaging member, and a coupler member attached within the receiver member. The coupler member has a coupler slot that snugly fits about the door latch handle effectively securing the engaging member to the door latch handle.

1 Claim, 10 Drawing Sheets

DOOR LATCH OPENING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to door latch handles and more specifically it relates to a door latch opening system for providing efficient and convenient opening of a door latch.

2. Description of the Related Art

Door latches have been in use for years. A door latch is comprised of a latch mechanism attached to the interior of a door near a door jam with a handle pivotally extending from the latch mechanism. FIGS. 1 and 2 illustrate an exemplary door latch structure. To open the door latch, the user presses upon the handle thereby actuating the latch mechanism into an open position.

The handles utilized upon door latches are often times relatively small in size and length. The size and length of the door latch handles makes them difficult to engage by a user of limited physical abilities or an individual carrying objects such as groceries.

Examples of patented devices which may be related to the present invention include U.S. Pat. No. 369,085 to Barnett; U.S. Pat. No. 5,713,614 to Anderson; U.S. Pat. No. 4,101,153 to Dozier; U.S. Pat. No. 4,223,931 to Neary; U.S. Pat. No. 5,231,731 to Jones, Jr.; U.S. Pat. No. 268,984 to Bergen; U.S. Pat. No. 289,369 to Foshee; U.S. Pat. No. 4,397,489 to Lind; U.S. Pat. No. 3,827,739 to Overholser; U.S. Pat. No. 280,799 to Ohno; U.S. Pat. No. 4,629,228 to Marko et al.; and U.S. Pat. No. 2,058,685 to Haan, Jr.

While these devices may be suitable for the particular purpose to which they address, they are not as suitable for providing efficient and convenient opening of a door latch. Door latch handles are difficult to open for individuals of limited physical abilities and for individuals carrying packages.

In these respects, the door latch opening system according to the present invention substantially departs from the conventional concepts and designs of the prior art, and in so doing provides an apparatus primarily developed for the purpose of providing efficient and convenient opening of a door latch.

BRIEF SUMMARY OF THE INVENTION

In view of the foregoing disadvantages inherent in the known types of door latches now present in the prior art, the present invention provides a new door latch opening system construction wherein the same can be utilized for providing efficient and convenient opening of a door latch.

The general purpose of the present invention, which will be described subsequently in greater detail, is to provide a new door latch opening system that has many of the advantages of the door latches mentioned heretofore and many novel features that result in a new door latch opening system which is not anticipated, rendered obvious, suggested, or even implied by any of the prior art door latches, either alone or in any combination thereof.

To attain this, the present invention generally comprises an engaging member have a broad engaging area, a receiver member attached to the rear portion of the engaging member, and a coupler member attached within the receiver member. The coupler member has a coupler slot that snugly fits about the door latch handle effectively securing the engaging member to the door latch handle.

There has thus been outlined, rather broadly, the more important features of the invention in order that the detailed description thereof may be better understood, and. in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a door latch opening system that will overcome the shortcomings of the prior art devices.

A second object is to provide a door latch opening system for providing efficient and convenient opening of a door latch.

Another object is to provide a door latch opening system that provides a larger surface area to engage by an individual.

An additional object is to provide a door latch opening system that is easily attached to an existing door latch handle without tools.

A further object is to provide a door latch opening system that fits upon various sizes of door latch handles.

Another object is to provide a door latch opening system that increases the effective length of a door latch handle.

A further object is to provide a door latch opening system that increases the leverage force applied to a door latch mechanism.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
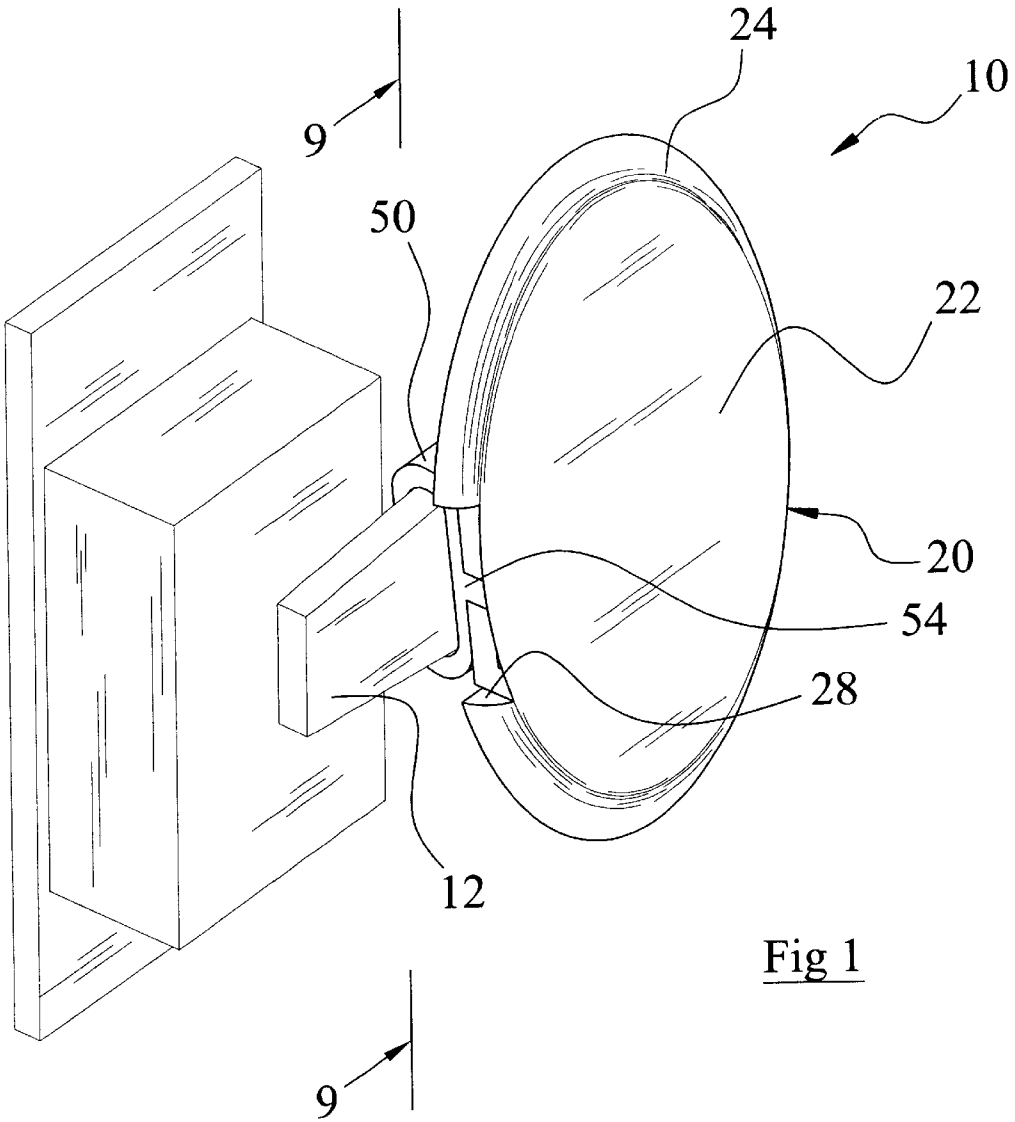
FIG. 1 is an upper perspective view of the present invention attached to the door latch handle.
Figure 2:
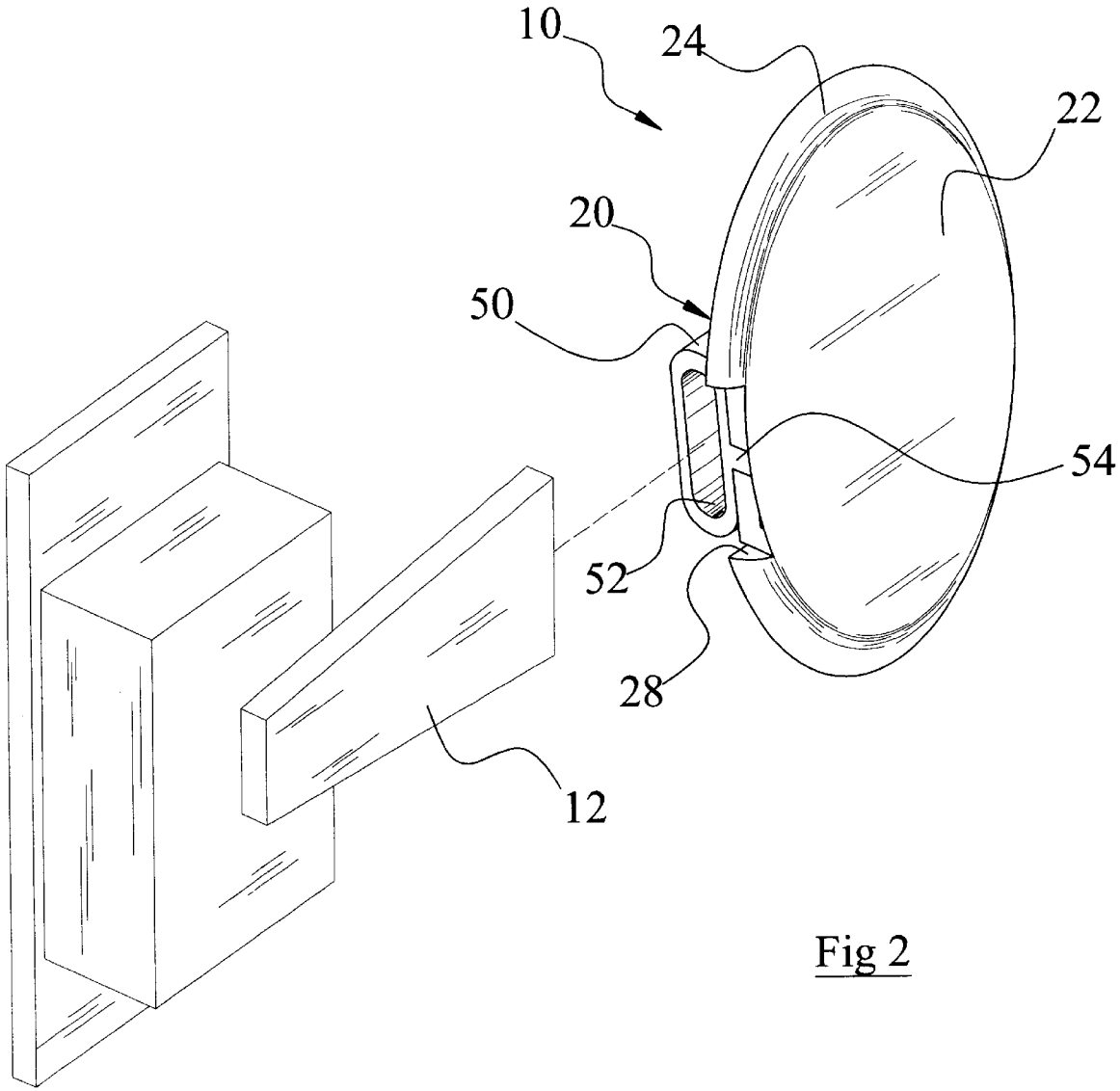
FIG. 2 is an exploded upper perspective view of the present invention with respect to a door latch handle.
Figure 3:
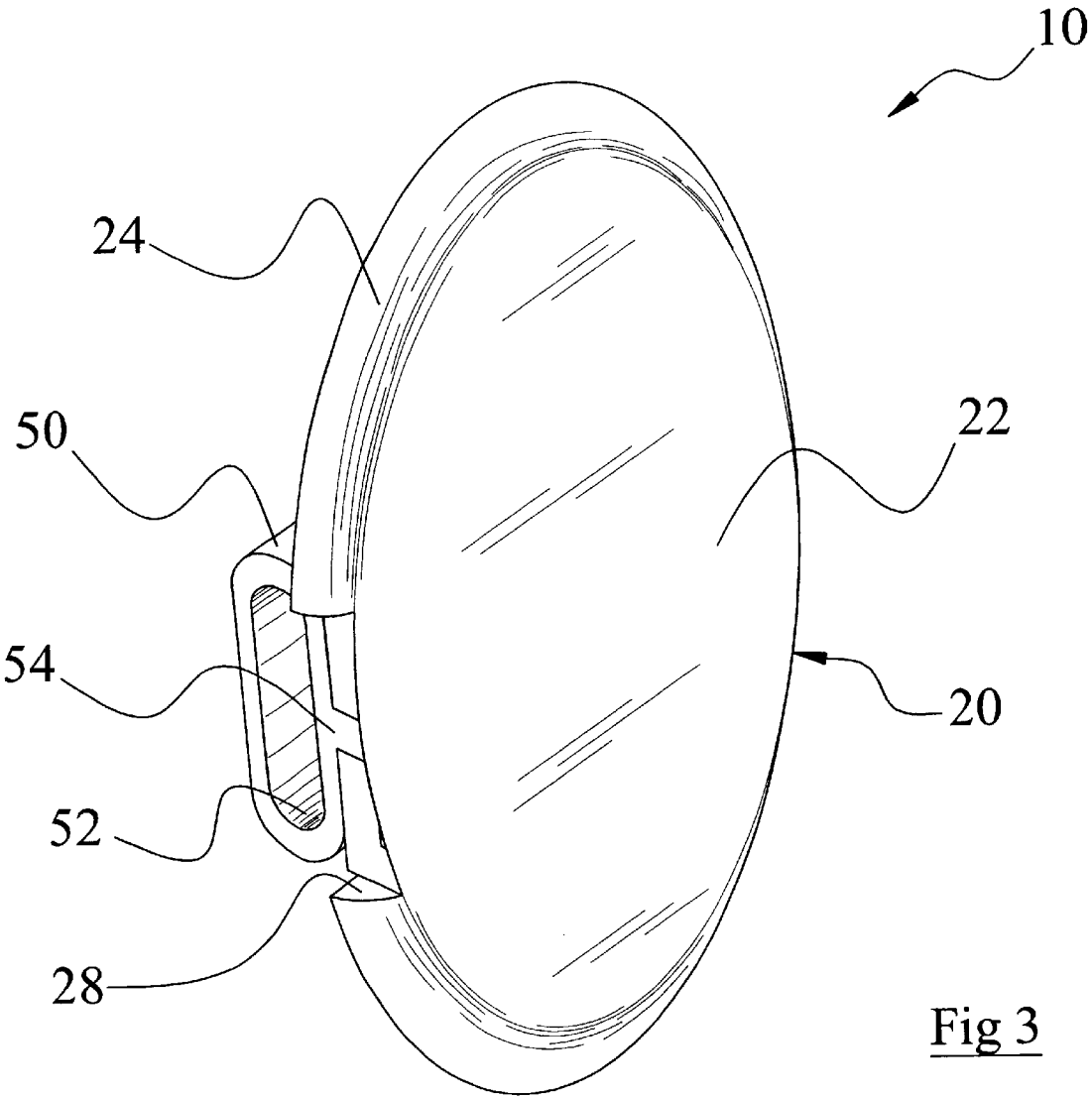
FIG. 3 is an upper perspective view of the present invention.

Turning now descriptively to the drawings, in which similar reference characters denote similar elements throughout the several views, FIGS. 1 through 9 illustrate a door latch opening system 10, which comprises an engaging member 20 have a broad engaging area, a receiver member 30 attached to the rear portion 26 of the engaging member 20, and a coupler member 50 attached within the receiver member 30. The coupler member 50 has a coupler slot 52 that snugly fits about the door latch handle 12 effectively securing the engaging member 20 to the door latch handle 12.

Figure 4:
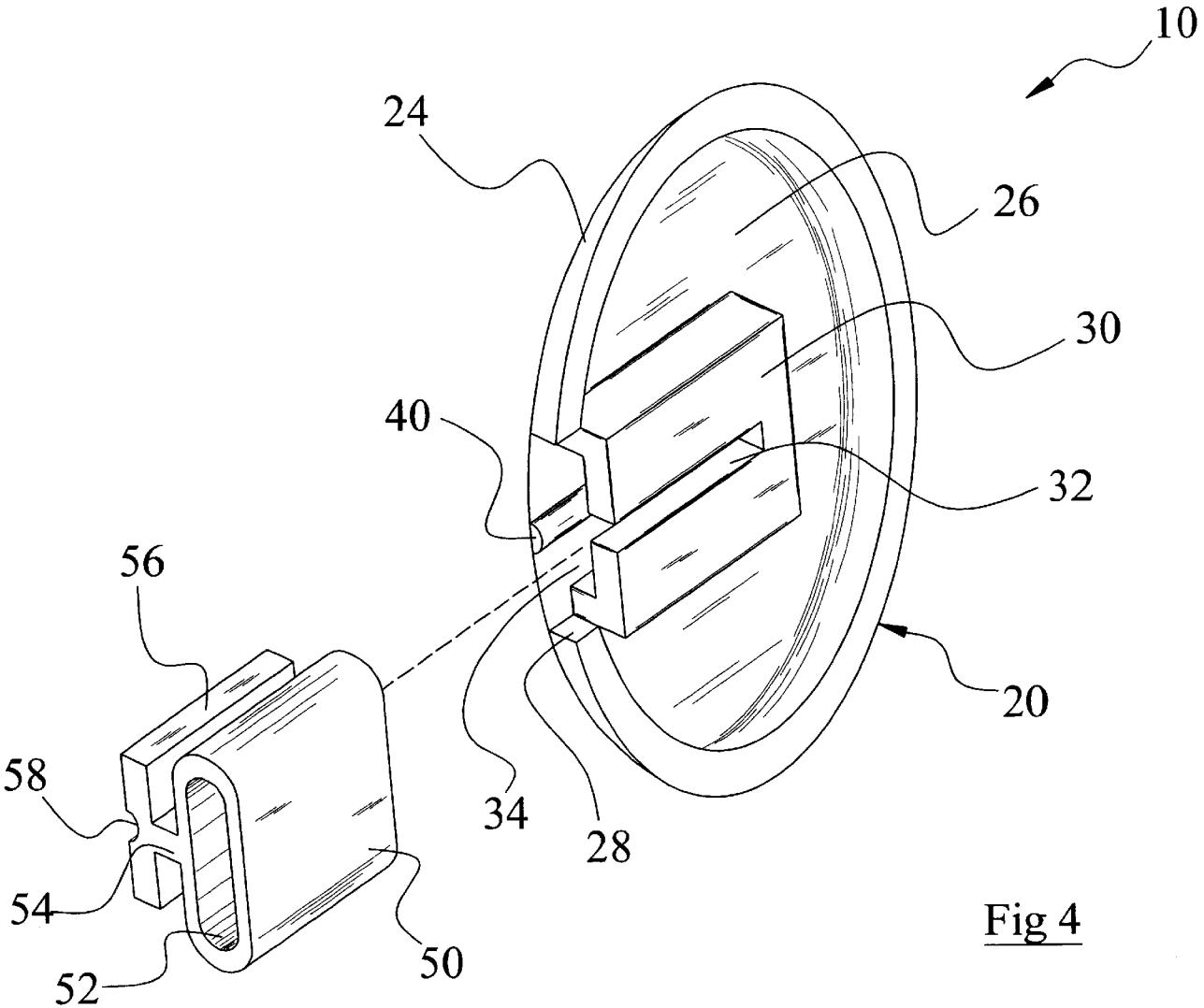
FIG. 4 is an exploded upper perspective view of the present invention.
Figure 5:
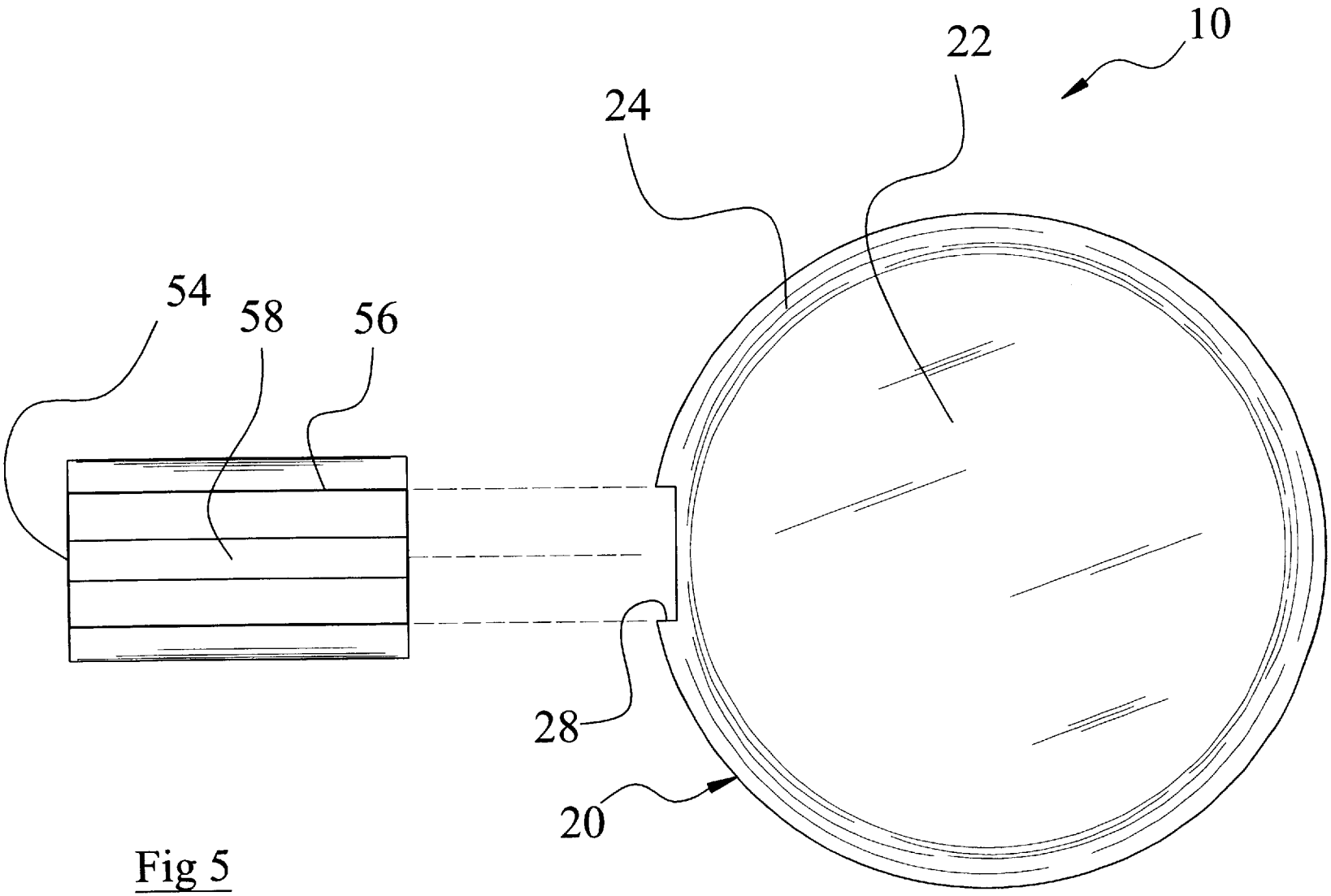
FIG. 5 is a front exploded view of the present invention.
Figure 10A:
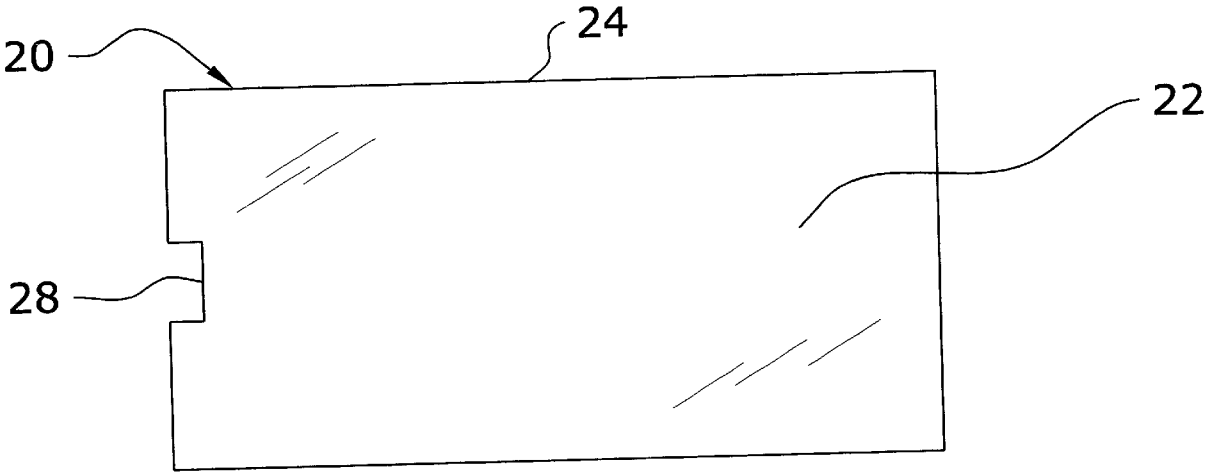
FIG. 10*a* is a front view of the engaging member having a rectangular shape.
Figure 10B:
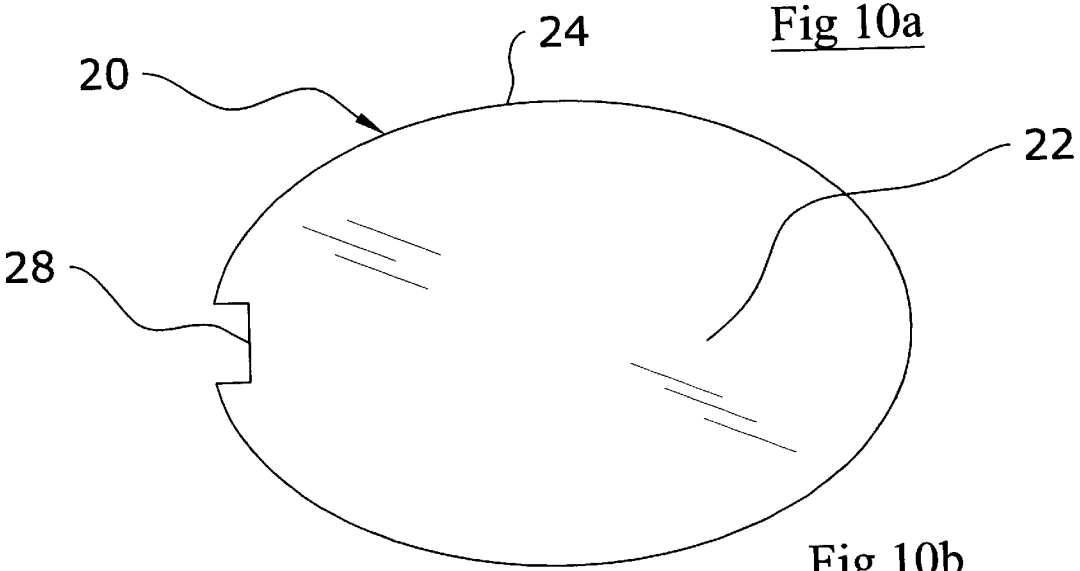
FIG. 10*b* is a front view of the engaging member having an oval shape.

As shown in FIGS. 1 through 6 of the drawings, the engaging member 20 is comprised of a relatively broad structure. The engaging member 20 preferably has a width and length greater than 3 inches. The engaging member 20 may have various shapes, thickness, widths, sizes and lengths. For illustration purposes only, the engaging member 20 is illustrated in the drawings as having a circular shape as shown in FIG. 5. However, the engaging member 20 may have various other shapes such as square, oval (FIG. 10*b*), rectangular (FIG. 10*a*) and the like.

The engaging member 20 has a front portion 22, a perimeter portion 24 and a rear portion 26. The user engages the front portion 22 of the engaging member 20. The front portion 22 may have a flat or non-flat structure.

The front portion 22 may also include a gripping design or material to facilitate gripping of the engaging member 20 by the user. The perimeter portion 24 of the engaging member 20 may be rounded, tapered or straight. The rear portion 26 may be comprised of a cavity structure as illustrated or a flat structure.

A side cutout 28 extends into the perimeter portion 24 of the engaging member 20 for providing access to the receiver member 30. If the rear portion 26 is not a cavity structure, then the side cutout 28 is not required.

The receiver member 30 is attached to the rear portion 26 near the side cutout 28. The receiver member 30 has a tubular structure with a receiver slot 34 and a rear slot 32. The rear slot 32 extends into the receiver member 30 from the opening. The rear slot 32 is longitudinal with the receiver member 30 and is connected to the receiver slot 34 as best illustrated in FIG. 4 of the drawings.

A guide rib 40 preferably extends upwardly from the rear portion 26 within the receiver slot 34 as shown in FIG. 4 of the drawings. The guide rib 40 extends longitudinally with respect to the receiver member 30. The guide rib 40 may have various cross sectional shapes such as but not limited to square, curved, triangular and rectangular.

The coupler member 50 is positionable within the receiver member 30 as shown in FIGS. 1, 2, 3, 6, 8 and 9 of the drawings. The coupler member 50 has a coupler slot 52 extending longitudinally within a main body that slidably and frictionally receives the door latch handle 12. The coupler slot 52 preferably has an oval, rectangular or oblong shaped cross section for snugly receiving the door latch handle 12. Adhesive, fasteners or other structures may be positioned between the coupler member 50 and the door latch handle 12 for securing thereto.

Figure 6:
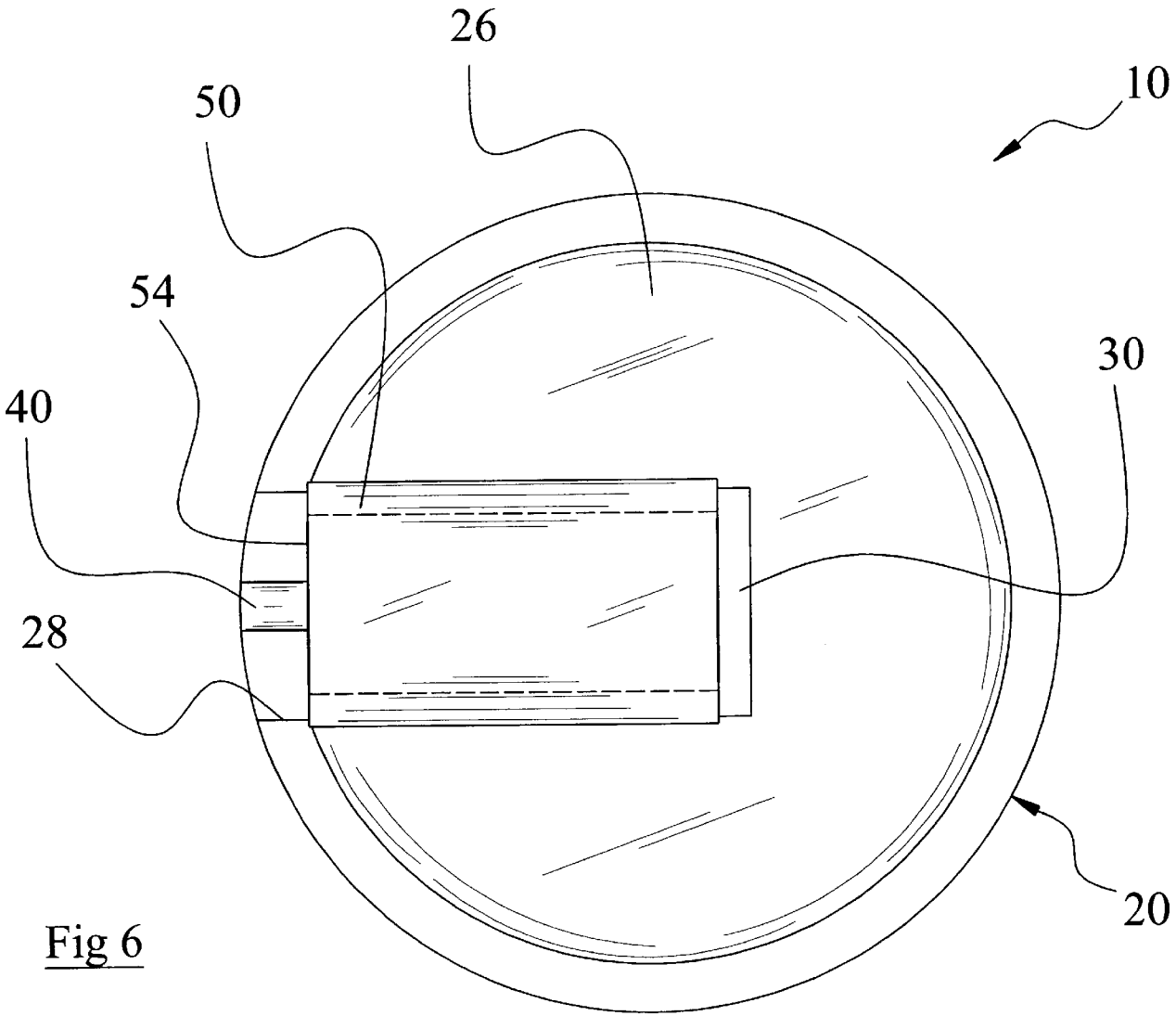
FIG. 6 is a rear view of the present invention.
Figure 7:
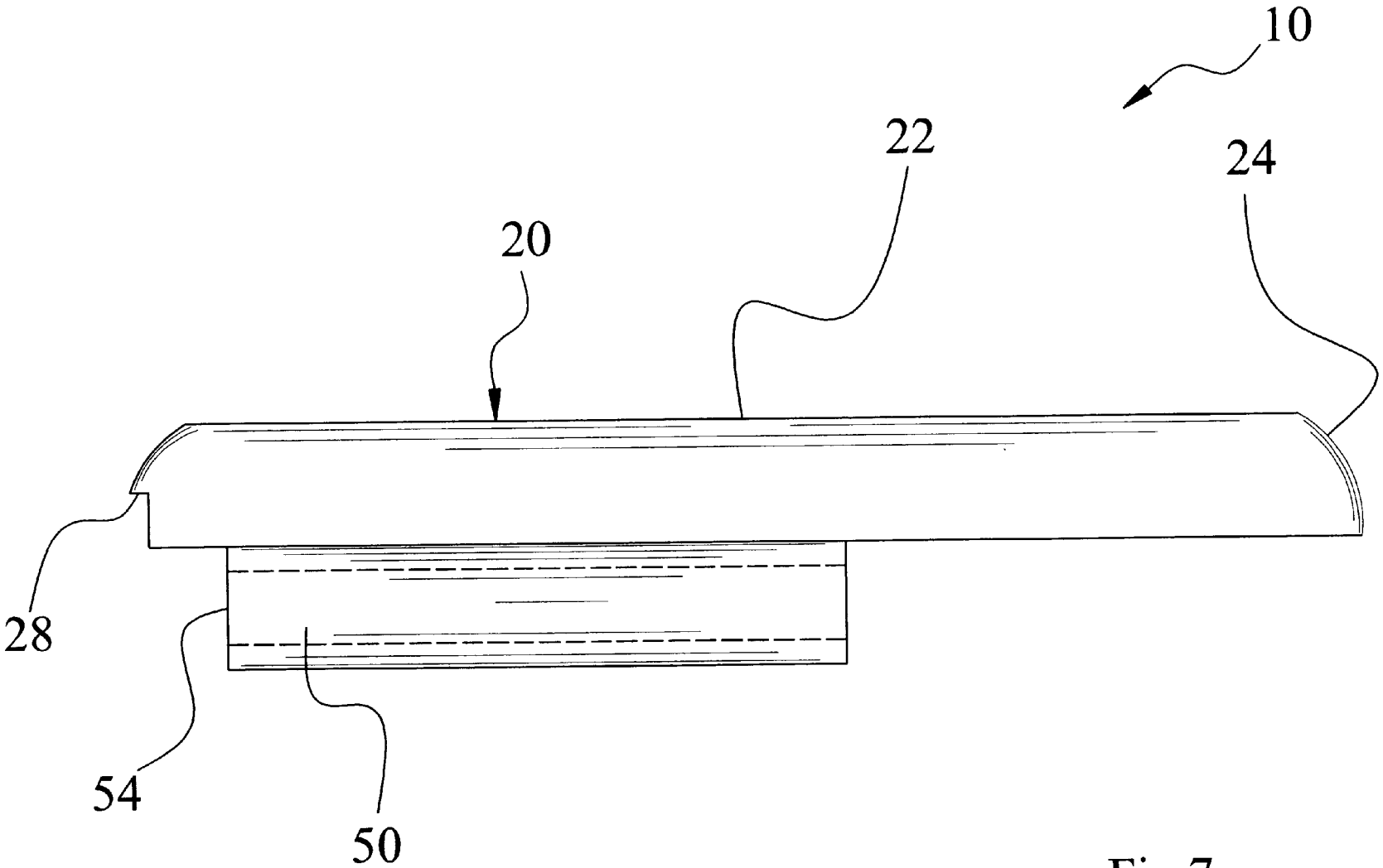
FIG. 7 is a bottom view of the present invention.
Figure 8:
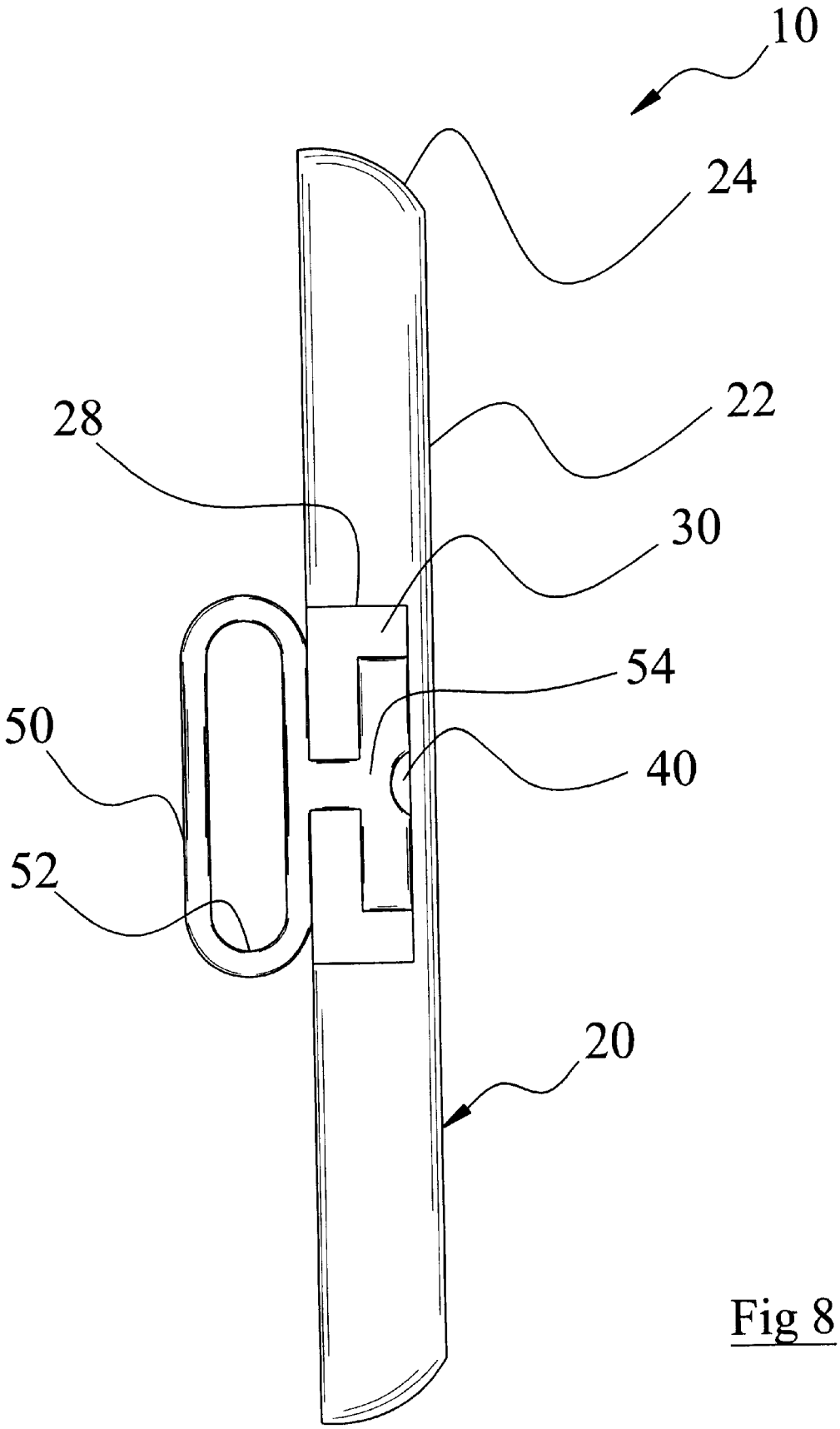
FIG. 8 is a front view of the present invention.
Figure 9:
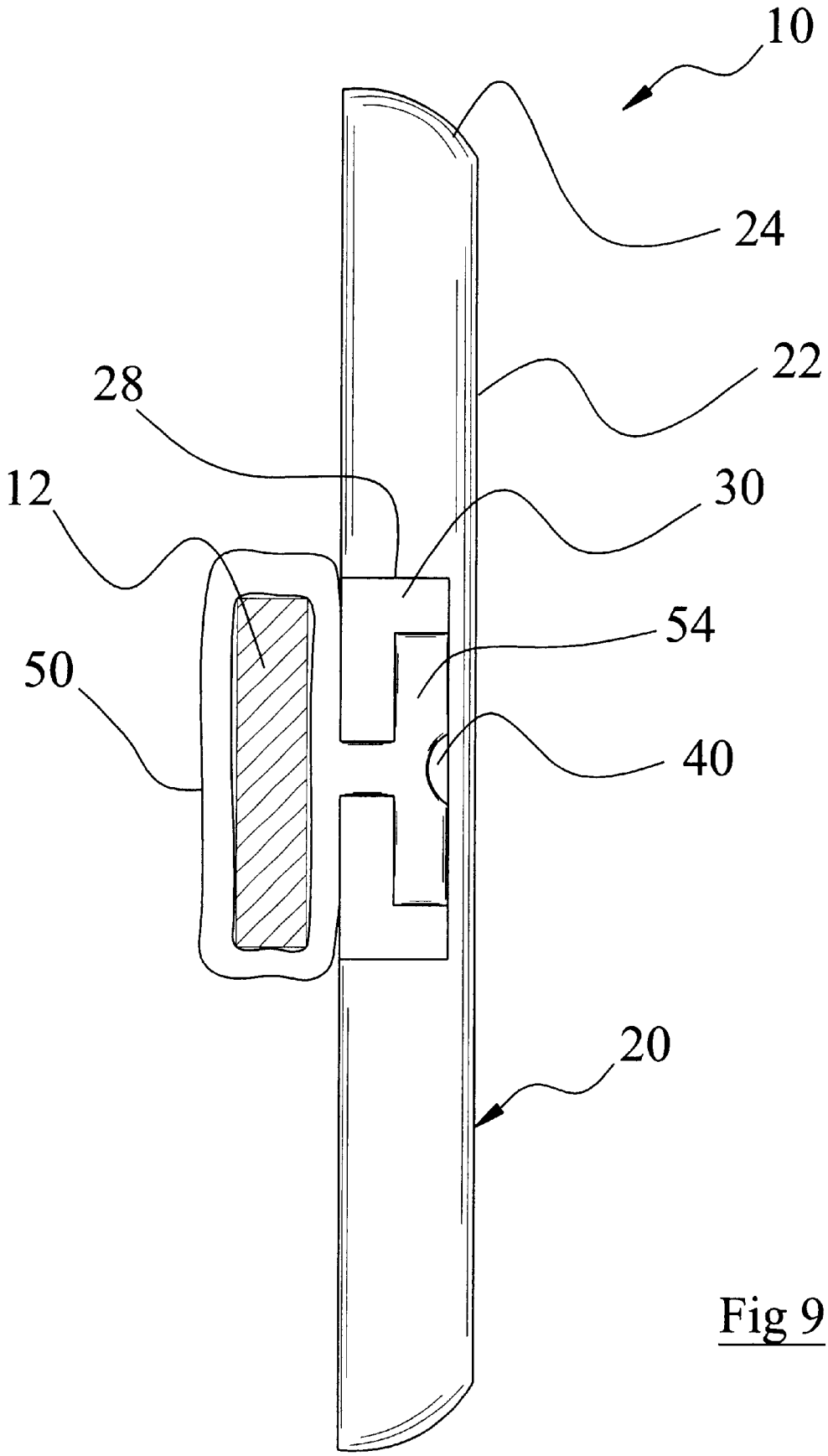
FIG. 9 is a cross sectional view taken along line 9—9 of FIG. 1.

The coupler member 50 has a connector portion 54 extending from the main body containing the coupler slot 52 as shown in FIG. 4 of the drawings. A base portion 56 is attached to the connector portion 54 opposite of the main body as shown in FIG. 4 of the drawings. The base portion.56 preferably has a guide channel 58 than slidably receives the guide rib 40. The guide channel 58 preferably has a shape and size similar to the guide rib 40. The base portion 56 is manipulated into the receiver slot 34 of the receiver member 30 with the connector portion 54 extending through the rear slot 32 of the receiver member 30 as shown in FIGS. 6 and 8 of the drawings. The coupler member 50 may be permanently secured within the receiver member 30 by an adhesive, fastener or similar connector structure.

Alternatively, the coupler member 50.may be directly connected to the rear portion 26 of the engaging member 20 in a single structure. The coupler member 50 in the alternative embodiment would not require the base portion 56, connector portion 54 or the guide channel 58.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of, operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door latch opening system attachable to a door latch handle, comprising:

a coupler member having a tubular coupler slot, wherein said tubular coupler slot frictionally retains and surrounds a door latch handle;

a connector portion extending from said coupler member;

a base portion having a flanged structure attached to said connector portion opposite of said coupler member;

an engaging member having a circular structure with a diameter greater than 3 inches, wherein said engaging member has a front portion for engaging by an individual;

a receiver member having a receiver slot and a rear slot, wherein said receiver member is attached to said engaging member and receives base portion of said coupler member;

a guide rib attached to a rear portion of said engaging member within said receiver slot; and a guide channel within said base portion corresponding to said guide rib.

* * * * *